US006202419B1

(12) United States Patent
Bissell

(10) Patent No.: US 6,202,419 B1
(45) Date of Patent: Mar. 20, 2001

(54) MOLECULAR KINETIC ENERGY CONVERSION DEVICE

(76) Inventor: Lawrence E. Bissell, 9224 Huston Rd., Chatsworth, CA (US) 91311

( * ) Notice: Subject to any disclaimer, the term of this patent is extended or adjusted under 35 U.S.C. 154(b) by 0 days.

(21) Appl. No.: 09/464,265

(22) Filed: Dec. 17, 1999

(51) Int. Cl.[7] ..... F01K 25/06
(52) U.S. Cl. ..... 60/649; 60/651; 60/671
(58) Field of Search ..... 60/649, 651, 671, 60/673

(56) References Cited

U.S. PATENT DOCUMENTS

| | | | | |
|---|---|---|---|---|
| 3,861,151 | * | 1/1975 | Hosokawa | 60/649 X |
| 3,972,195 | * | 8/1976 | Hays et al. | 60/649 X |
| 4,085,591 | * | 4/1978 | Bissell | 60/649 X |
| 4,249,385 | * | 2/1981 | Bissell | 60/649 X |
| 4,387,576 | * | 6/1983 | Bissell | 60/649 |

* cited by examiner

*Primary Examiner*—Hoang Nguyen
(74) *Attorney, Agent, or Firm*—Albert O. Cota

(57) ABSTRACT

A device which can convert energy of latent heat at an ambient temperature, without a change of temperature, to power to kinetic energy of motion and levitation of mass, by a manufactured molecular force which acts only in one direction.

70 Claims, 8 Drawing Sheets

MOLECULAR KINETIC ENERGY CONVERSION DEVICE

TECHNICAL FIELD

The invention pertains to the general field of heat engines, and more particularly to a device which can convert latent heat of a working fluid at ambient temperature to energy of another form without change of temperature of the heat.

BACKGROUND ART

This art derives from that of steam power which wastes the latent heat of evaporation which changes liquid molecules to gas molecules. Despite this great loss, steam power was the predominant power source during the industrial revolution.

Previously, heat was thought to be a mysterious caloric fluid, which did work somewhat similar to water in a water mill. Despite the advent of acceptance by science of the molecular theory and the kinetic theory of matter, which posit heat in a substance as molecular vibratory kinetic energy of the substance, scientists and others well versed in thermodynamics to this day resolutely deny any possible relationship between the molecule and thermodynamic art. This is because of implanted error. Nothing could be farther from the scientific truth than this legendary dogma.

The second law of thermodynamics as a rule applying to sensible heat, and only to sensible heat is correct—that sensible heat must change temperature to do work. But as a law applying also to latent heat, which does not and cannot change temperature, as presently it taught is a psuedo scientific hobgoblin of misinformation seemingly contrived to scare off any attempt to convert latent heat. In this it has been eminently successful for some 150 years.

Molecules of a substance that can change phase will have a much greater distance of vibratory motion when in the gas phase then when in the liquid phase when both phases are at the same temperature and pressure. Their molecular vibratory kinetic energy (MVKE), which is their heat content, will be proportionately much greater in the gas molecules and smaller in the liquid molecules because their MVKE will be proportional to the square of their velocities, and since their frequency, or time period of vibratory motion, is the same, the velocity of the gas molecules will need to be much greater in order to move a much further distance within the same time period.

When phase changeable gas molecules impact a means for converting MVKE and do work, they will become liquid molecules by yielding the MVKE which caused them to change from liquid to gas. This will cause a local vacuum.

MVKE of the gas molecules previously has been considered impossible to convert to work because their vibratory motion causes a balance of force of the MVKE in all directions. This circumstance is remedied simply by combining a displacement system of motion with the molecular vibratory system. This motion can be caused by the local vacuum.

This causes addition of vibratory motion velocity to displacement motion velocity in the fore direction and subtraction of vibratory motion velocity from displacement motion velocity in the aft direction. This imbalance of forces results in a net molecular monodirectional force in the fore direction which can do work.

A search of the prior art, which included U.S. patents and technical literature, did not disclose any apparatuses or processes which read directly on the claims of the present invention. However, the following U.S. patents issued to the applicant, are considered related:

| U.S. PAT. NO. | INVENTOR | ISSUED | |
|---|---|---|---|
| 4,387,576 | Bissell | 14 June | 1983 |
| 4,249,385 | Bissell | 10 February | 1981 |
| 4,085,591 | Bissell | 25 April | 1978 |

The U.S. Pat. No. 4,387,576 patent is a continuation-in-part of the U.S. Pat. No. 4,249,385 patent and discloses usage of exhaust of an internal combustion gas turbine and its heat as the gas mixed with the evaporable liquid, the vapor mixture of which would supply a vapor turbine which could be connected by a common shaft to the gas turbine.

The U.S. Pat. No. 4,249,385 patent discloses a two-phase thermal energy conversion system which employs a mixture of vapor of an evaporable liquid such as water with a gas such as air which is not liquefiable within the operating range of temperature and pressure of the system. Heat of vaporization is supplied by one or both the liquid and gas and may be below the boiling point of the liquid. The increase of pressure or volume is converted to mechanical power by a prime mover while the temperature and pressure are reduced.

The U.S. Pat. No. 4,085,591 patent discloses a continuous flow evaporative-type thermal energy recovery apparatus. The apparatus evaporates hot water into air, preferably to saturation of the air, which is then supplied to a low pressure gas turbine. The turbine, in turn, performs work by expansion of the mixture of hot water vapor and air.

DISCLOSURE OF THE INVENTION

A device for manufacture of a molecular monodirectional force which is independent of an equal force in the opposite direction, by means of a working fluid which is independent of change in temperature which may be ambient, is disclosed. This force is called the M force.

Also disclosed is:

a) means for manufacture of the working fluid which can be a mixture of phase changeable gas with gas which does not change phase, b) means for converting molecular vibratory kinetic energy (MVKE) to power, and storage of the power, c) means for converting seawater to fresh water, d) means for converting MVKE to kinetic energy of displacement motion of mass, e) means for converting kinetic energy of displacement motion of mass to power, f) means for causing levitation of mass, g) means for converting MVKE to potential energy of gravity of displacement motion of mass, and h) means for converting potential energy of gravity of displacement motion of mass to power.

Both sensible and latent heat gain molecular vibratory kinetic energy by increase of velocity of vibratory motion. Molecules in the liquid phase can experience vibratory motion over only a limited distance of travel. To increase in velocity these liquid molecules must travel this distance in a shorter time period. This means their vibratory frequency must increase, which means that their temperature must increase, and therefore their sensible heat has changed by the increase of temperature.

When the liquid molecules change phase to gas molecules they experience vibratory motion over a vastly increased distance of travel, and therefore with a vast increase of velocity, while remaining at the same vibratory frequency, temperature and pressure, and therefore their latent heat has changed by increase.

The totally random direction of vibratory motion of the gas molecules causes their force of kinetic energy of latent heat to be distributed uniformly in all external directions. This balance of force might appear to be incapable of conversion to energy of another form but this is not the case.

The same system of random vibratory motion of the gas molecules in all external directions which ensures a balance of force also will ensure an imbalance of force favoring a direction in which a displacement system of motion causes displacement motion to the vibratory system of motion of the gas molecules. This is because velocity of vibratory motion of the molecules in the same direction as the displacement motion will be added to the velocity of the displacement motion, whereas velocity of vibratory motion of the molecules in the opposite direction to the displacement motion will be subtracted from the velocity of the displacement motion.

A very important consideration is that velocity, and not simply kinetic energy, is added and subtracted. This is because velocity is proportional to the square of kinetic energy. Because of this fact a nonlinear distribution of kinetic energy results that causes a molecular microdynamic monodirectional force to be generated in the direction of the displacement motion. This force is called the M force, which can cause the conversion of molecular vibratory kinetic energy of latent heat to another form of energy.

These and other objects and advantages of the present invention will become apparent from the subsequent detailed description of the preferred embodiment and the appended claim taken in conjunction with the accompanying drawings.

BEST MODE FOR CARRYING OUT THE INVENTION

The best mode for carrying out the invention is presented in terms of a preferred embodiment for a device 10 which converts a potential molecular vibratory kinetic energy (MVKE) 16 to an energy of another form 36 by means for a manufactured M-force 32.

Figure 1A:
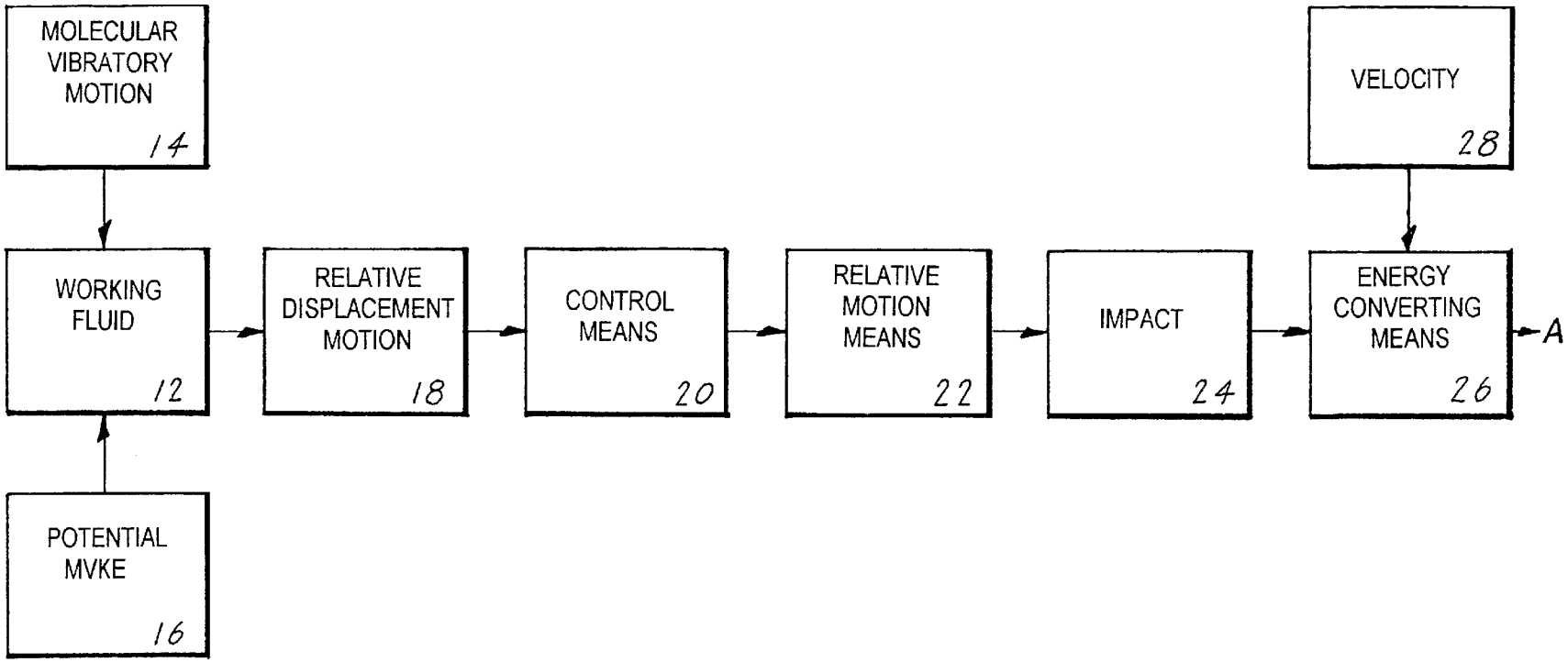
FIGS. 1A and 1B are a block diagrams of the major elements that comprise the molecular kinetic energy conversion device when displacement motion is prevented.
Figure 1B:
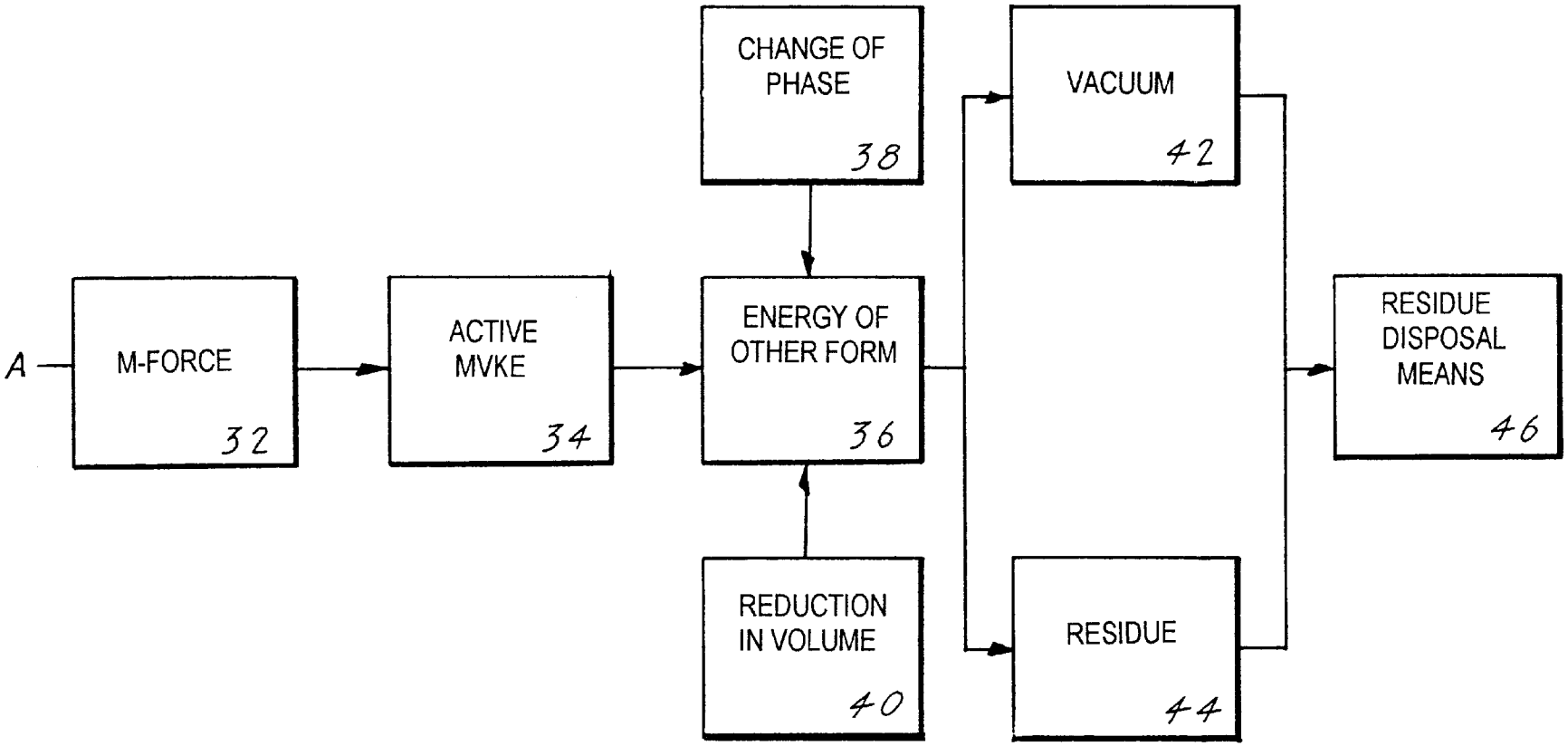

The basic design configuration for producing the molecular microdynamic monodirectional force, hereinafter M-force 32, is shown in FIGS. 1A and 1B, and is comprised of a phase changeable working fluid 12 having a natural molecular vibratory motion 14 and a potential MVKE 16. The fluid 12 is combined with a means 22 for causing a relative displacement motion 18 between the fluid 12 and the means 22. The means 22 can be comprised of a pump. A control means 20 for controlling relative displacement motion 18 can be comprised of a valve. The relative displacement motion 18 occurs in relation to an energy converting means 26 in such a manner that an impact 24 with a velocity 28 of the relative displacement motion 18 will occur between the fluid 12 and the energy converting means 26. This impact 24 also causes the velocity 28 of the molecular vibratory motion 14 and the velocity 28 of the relative displacement motion 18 to combine and produce the M-force 32, a conversion of an active molecular vibratory kinetic energy 34 to an energy of another form 36, a change of phase 38 within the fluid 12 which causes a reduction in the volume 40 of the working fluid 12, a vacuum 42 and a residue 44 of the working fluid 12. A means 46 for disposing of the residue is provided. Presence of motion prevention means 48 prevents displacement motion 19 of device 10.

Figure 2:
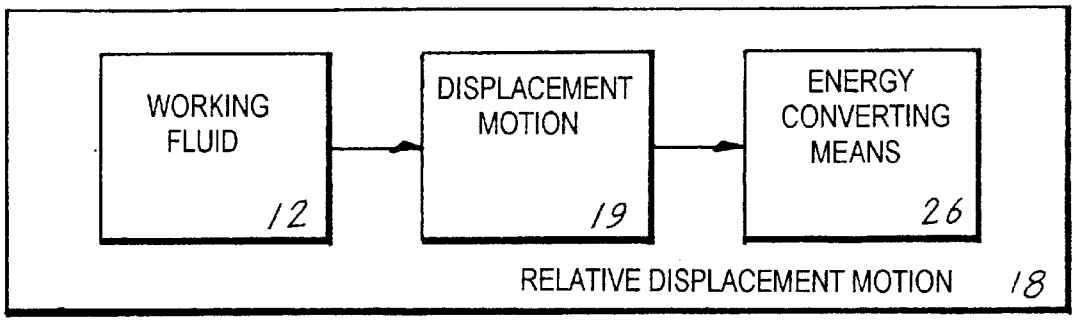
FIG. 2 is a block diagram of the elements that comprise the relative displacement motion.

As shown in FIG. 2, the relative displacement motion 18, which applies only to motion between the fluid 12 and the energy converting means 26, can be comprised of a displacement motion 19 of the fluid 12 toward the energy converting means 26, the motion 19 of the energy converting means 26 toward the fluid 12 or of the motion 19 of the fluid 12 and the energy converting means toward each other.

The fluid 12 can be comprised of a phase changeable gas 64 or a mixture of 64 with a gas 66 which does not change phase. The change of phase 38 of the gas 64 in the fluid 12 causes the vacuum 42, as shown in FIGS. 1A and 1B which can become the means 22 for causing the relative displacement motion 18.

When the energy converting means 26 is comprised of a transducer such as a vapor turbine and the other form of the energy 36 is comprised of power 50, the power 50 can be stored in a power storage means 52. The power 50 also is used to power the means 22 for causing the relative displacement motion 18, as in the startup of the device 10, and to power the means 46 for disposing of the residue 44 of the fluid 12.

The M-force 32 acting on the converting means 26 also will cause the displacement motion 19 to the device 10 in a direction 78 away from the fluid 12 and of the M-force 32 unless the motion 19 of the device 10 is prevented by a means 48 which can be of anchorage of the device 10 to the earth, by the opposing force of gravity 70 or by an opposing M-force 32.

Figure 3:
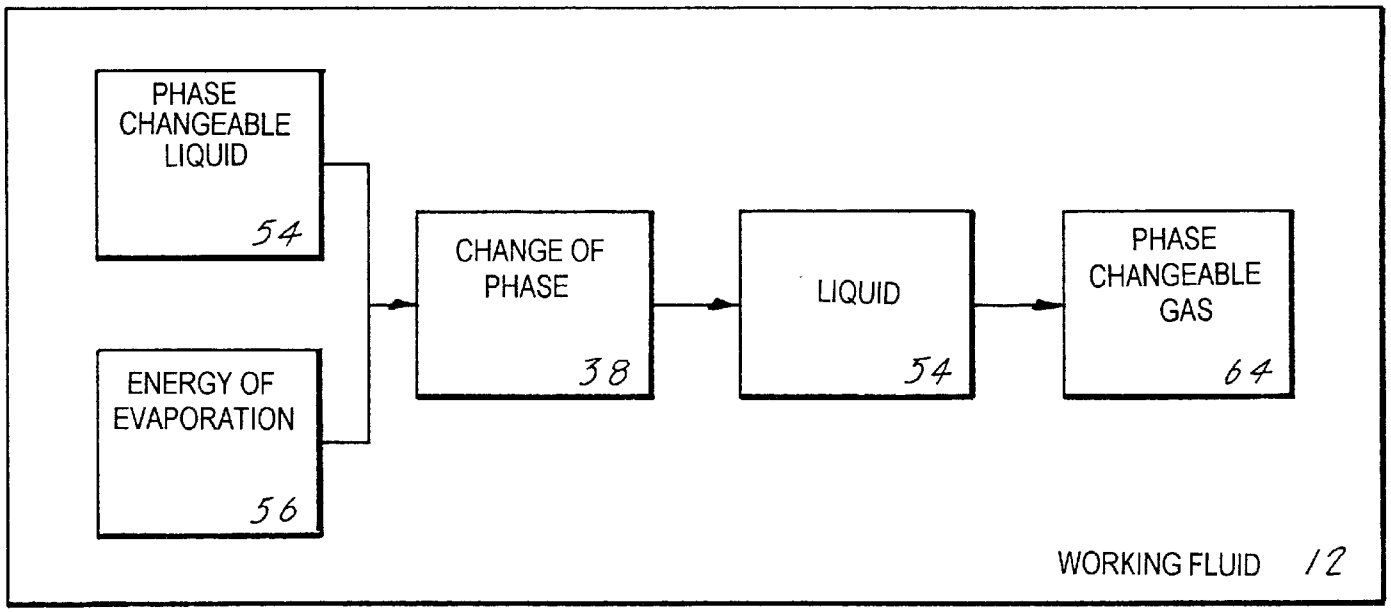
FIG. 3 is a block diagram showing how a different form of a working fluid is manufactured by the device.

As shown in FIG. 3, the working fluid 12 can be manufactured by the device 10 in which a phase changeable liquid 54 is combined with an energy of evaporation 56 to cause a change of phase 38 to the liquid 54 and thereby comprise a phase changeable gas 64. Because the gas 64 provides a latent heat 76 upon impact 24, a high temperature of the fluid 12 and the gas 64, and therefore of the energy 56 is not necessary. Therefore choice of a liquid 54 with a low boiling temperature could be evaporated by the energy 56 in the form of extracted heat which causes refrigeration. The gas 64 when condensed to the liquid phase as the residue 44 can comprise of the liquid 54.

Figure 4:
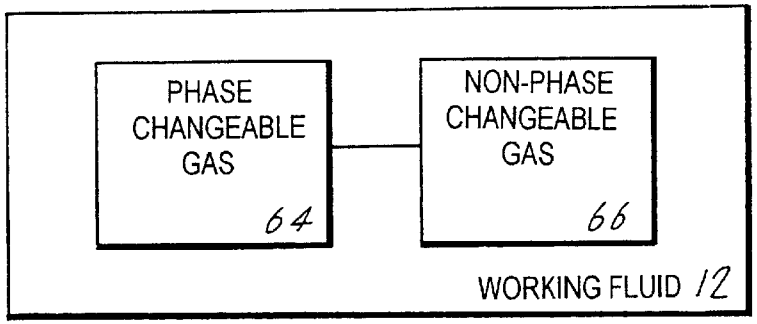
FIG. 4 is a block diagram showing how one form of a working fluid is manufactured by the device.

The working fluid 12, as shown in FIG. 4 also can be comprised of a mixture of the phase changeable gas 64 with a gas 66 which does not change phase. Atmospheric air of sufficient humidity is an example of such a mixture.

Seawater as a liquid 58, an impure form of the liquid 54, when finely dispersed in atmospheric air as the gas 66 by a known means can be evaporated to comprise the gas 64 by the supply of energy of evaporation 56 from heat naturally contained in either or both the gas 66 and the liquid 58. A concentrate of an impurity 62 of liquid 58 as salt can be obtained in addition to purified water 60 from the residue 44 of the fluid 12.

When either salt as the concentrate 62 of the impurity of the liquid 58, or purified water 60 as the residue 44 of the fluid 12 is the prime desideratum, the power 50 can become the energy of evaporation 56 in addition to evaporation 56 from another source, thereby raising the temperature and speeding the process of obtainment.

Figure 5:
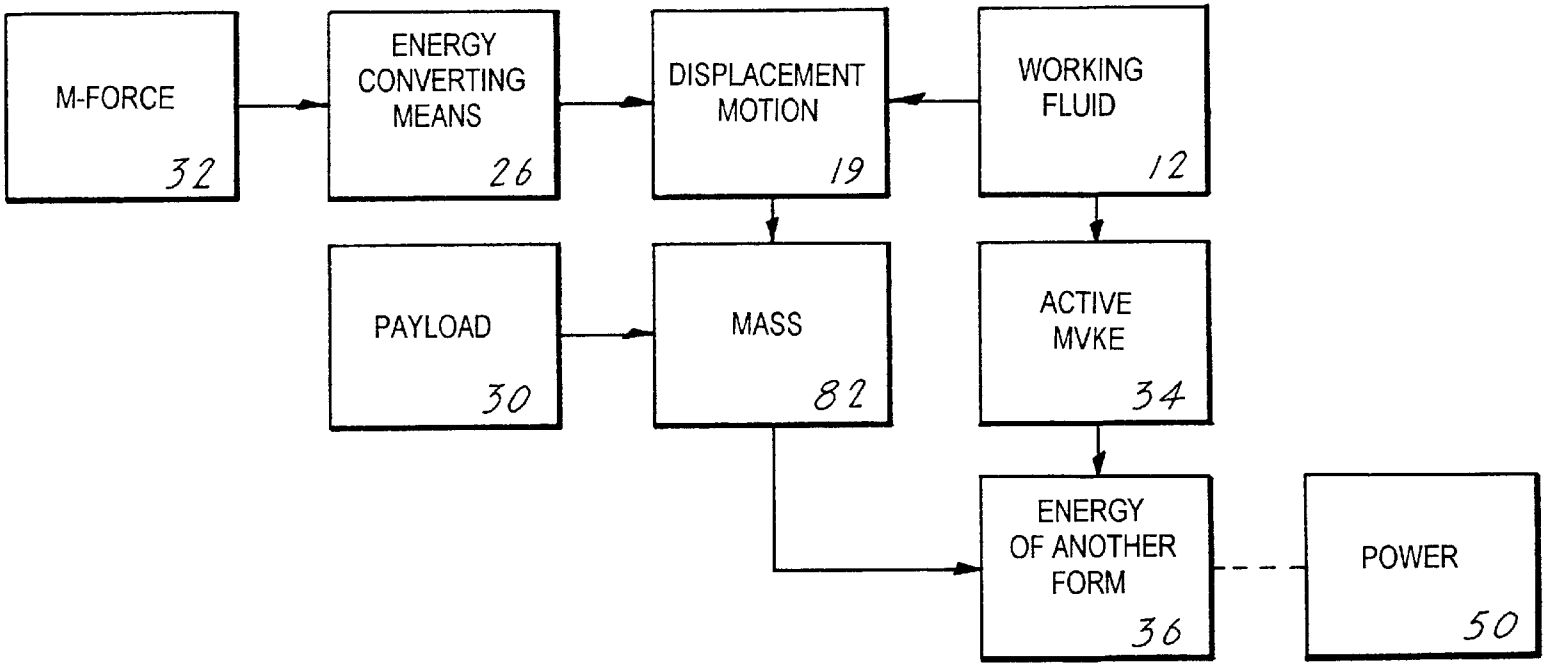
FIG. 5 is a block diagram showing how the active MVKE is converted to (1) an energy of another form involving power and (2) to the energy of another form involving the motion of a mass.

The M-force 32 acting on converting means 26, as shown in FIG. 5, causes the displacement motion 19 to the device 10 in a direction 78 away from the fluid 12. This event also converts the active MVKE 34 of the fluid 12 not only to the energy of another form 36 comprising the power 50, but also to the energy of another form 36 comprising energy 92 of the displacement motion 19 of a mass 82, including a payload 30 attached to the device 10.

Figure 6:
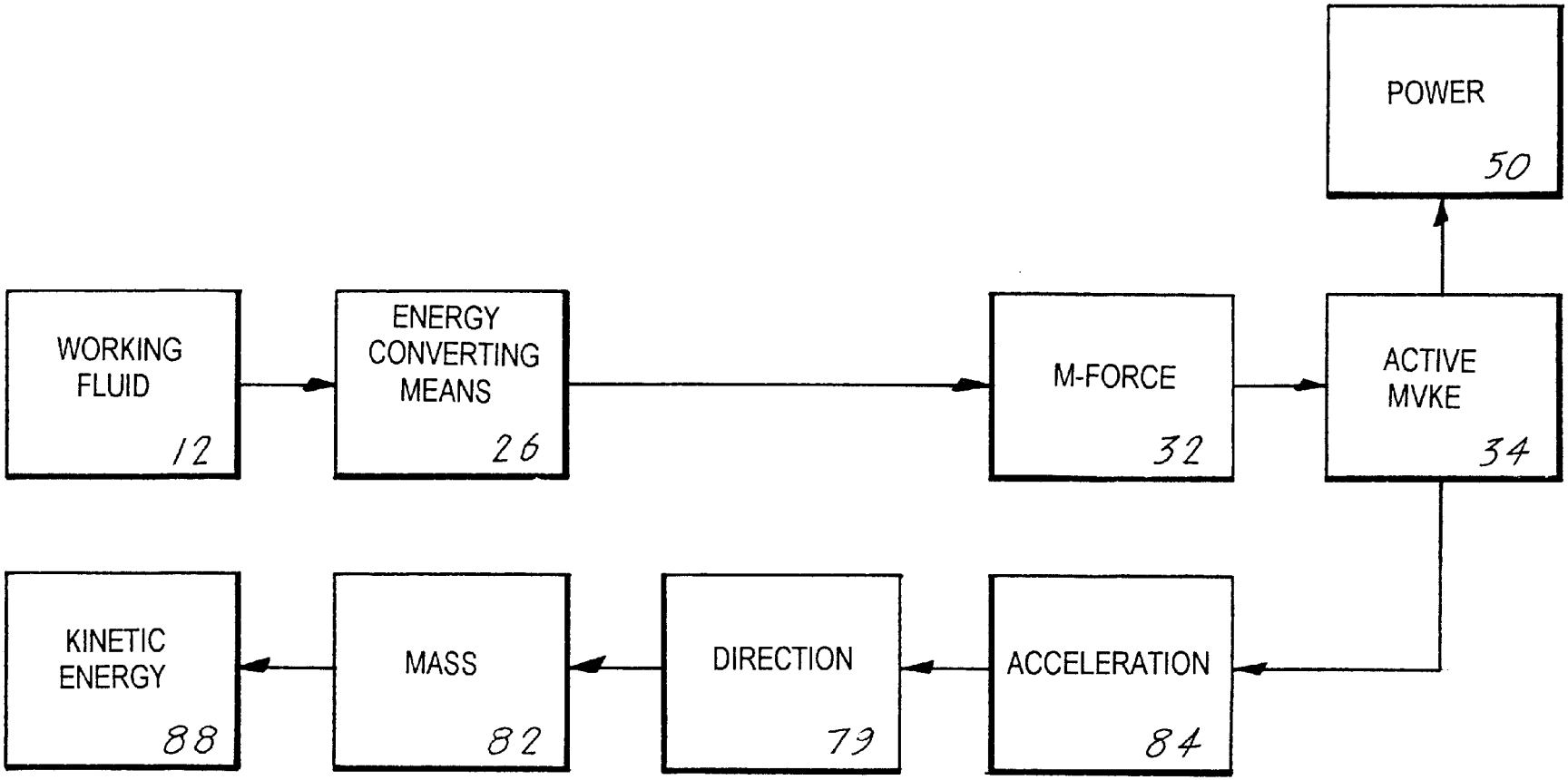
FIG. 6 is a block diagram showing how the active MVKE is converted to the kinetic energy of a mass and also to a power.

When the working fluid 12 combines with energy converting means 26 causing M-force 32, as shown in FIG. 6, causes an acceleration 84 of the mass 82 of the device 10 in the direction 79 away from fluid 12, the active MVKE 34 will be converted to the kinetic energy 88 of the mass 82 of the device 10, and also the active MVKE 34 is converted to the power 50 which process thereby generates the necessary M-force 32 to cause the acceleration 84 of the motion 19 of the mass 82 of the device 10.

Figure 7:
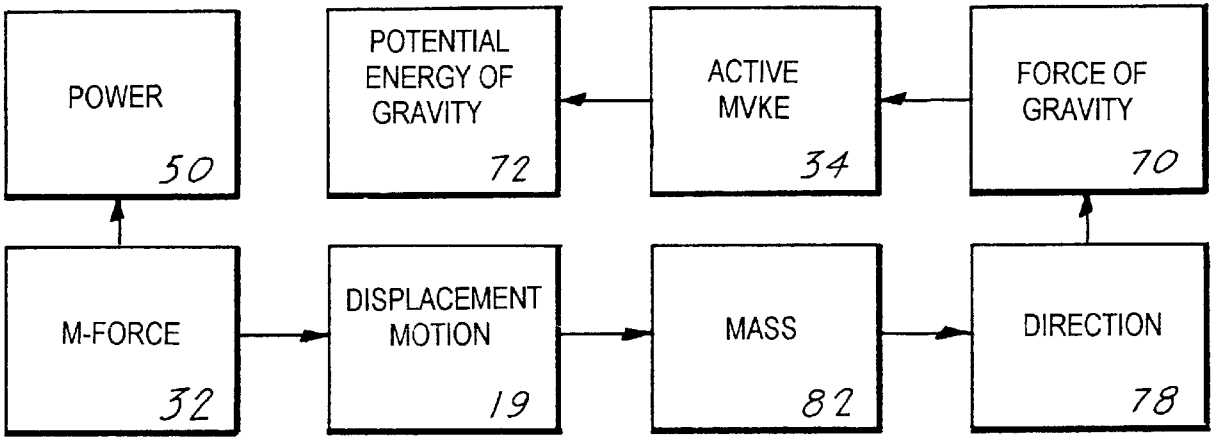
FIG. 7 converts MVKE to potential energy of gravity.

When the M-force 32, as shown in FIG. 7 causes the motion 19 of the mass 82 of the device 10 in the direction 78 in opposition to the force of gravity 70, the active MVKE 34 will be converted to the potential energy of gravity 72 of the mass 82 of the device 10 and also the active MVKE 34 is converted to the power 50 which process thereby generates the necessary M-force 32 to cause the motion 19 of the mass 82 of the device 10 in opposition to the force of gravity 70.

Figure 8:
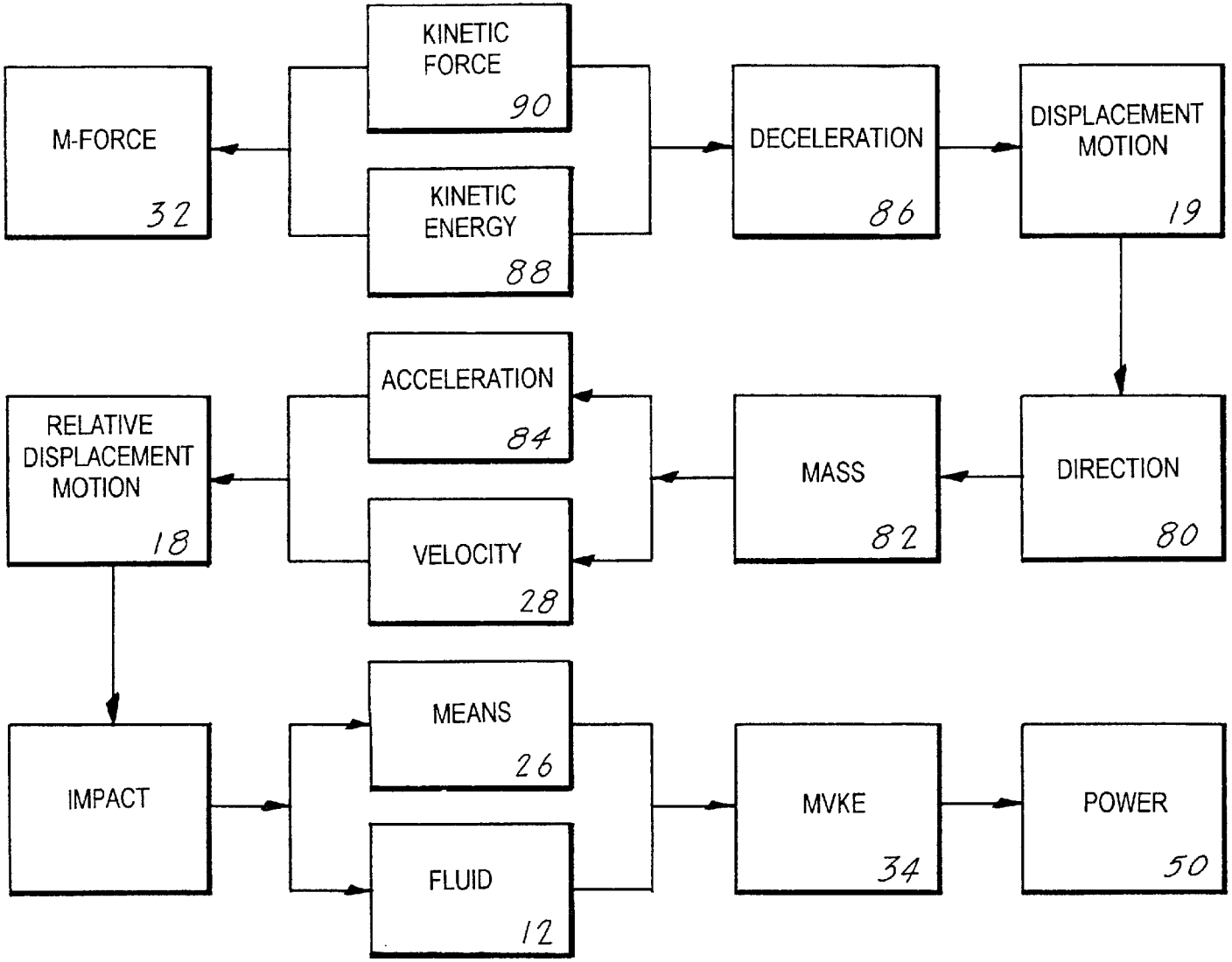
FIG. 8 converts deceleration of mass to power.

As shown in FIG. 8 when the kinetic force 90 of the kinetic energy 88 of the mass 82 of the device 10 exceeds the M-force 32 and thereby causes deceleration 86 of the motion 19 in the direction 80 toward the fluid 12 of the mass 82 of the device 10, the kinetic energy 88 of the mass 82 of the device 10 will be converted to the active MVKE 34 of the fluid 12 and thence to the power 50 by the acceleration 84 of the velocity 28 of the motion 18 of the impact 24 between the converting means 26 and the fluid 12.

Figure 9:
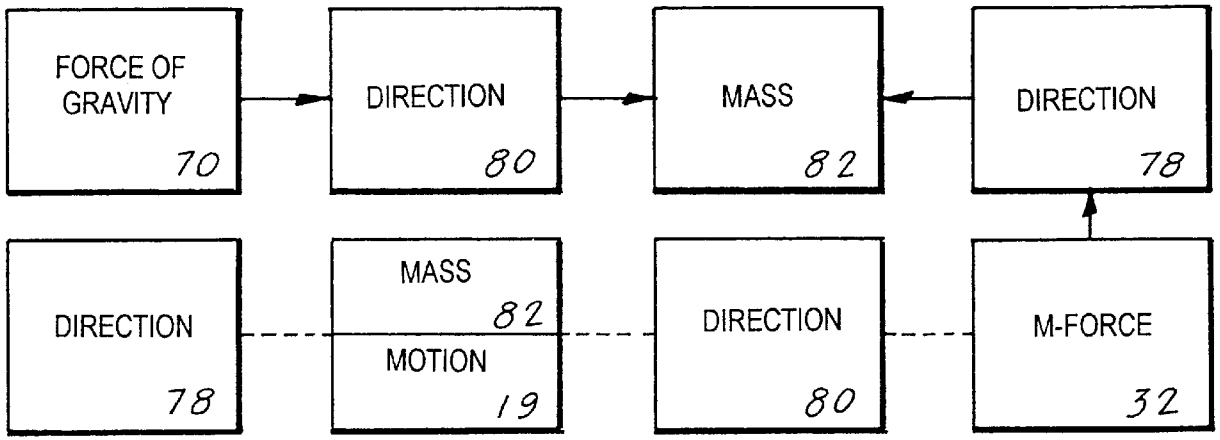
FIG. 9 shows how M-force balances gravity.

As shown in FIG. 9 when the force of gravity 70 which acts on the mass 82 of the device 10 in the direction 80 is balanced by the M-force 32 which acts in the direction 78, the motion 19 of the mass 82 is suspended.

Figure 10:
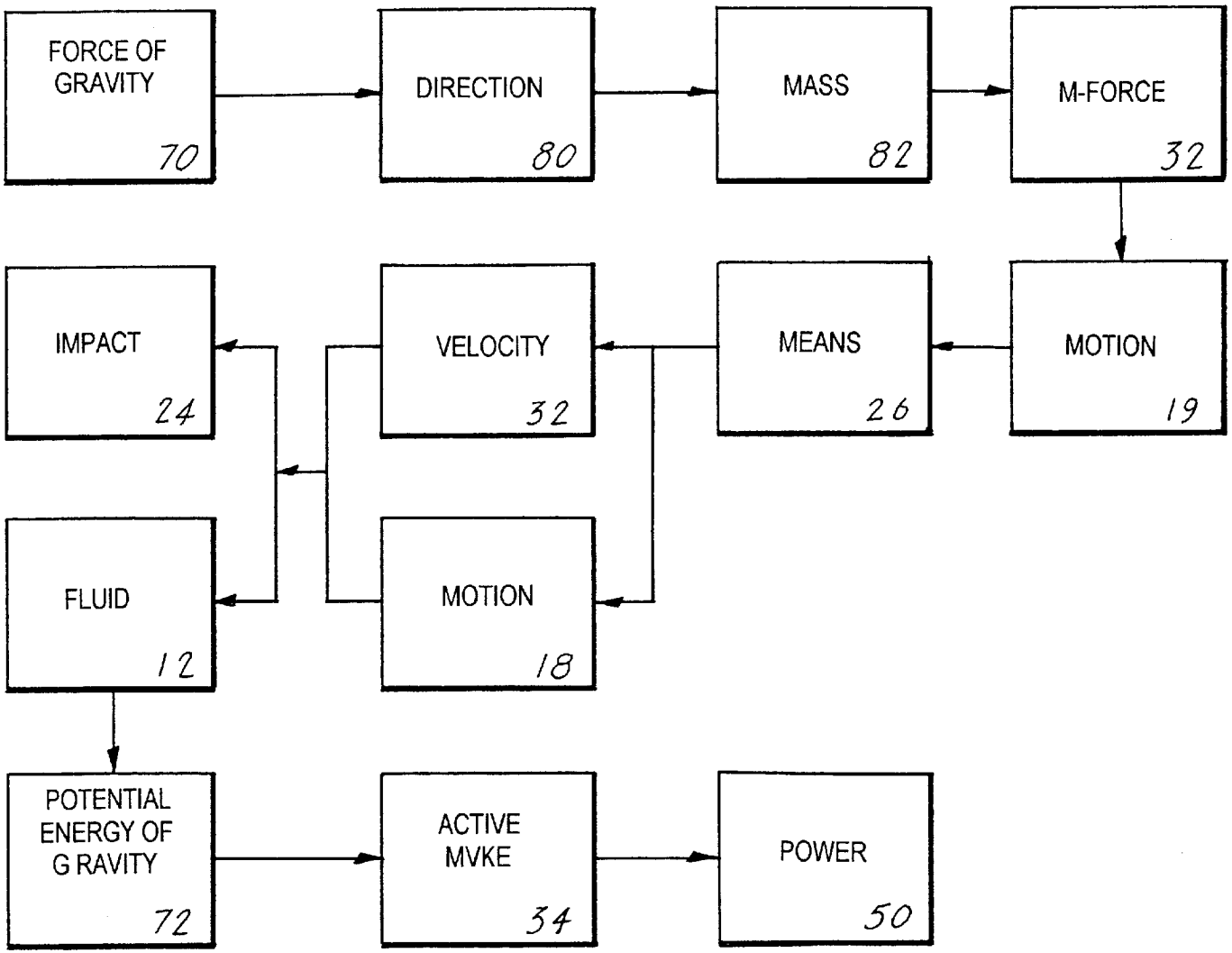
FIG. 10 shows how potential energy of gravity is converted to power.

As shown in FIG. 10 when the force of gravity 70 which acts on the mass 82 of the device 10 in the direction 80 toward the fluid 12 exceeds the M-force 32, motion 19 of the mass 82 of the device 10 in the direction 80 toward the fluid 12 will be caused, thereby causing the motion 19 of the means 26 toward the fluid 12, whereby the velocity 28 of the motion 19 of the means 26 toward fluid 12 will be added to the velocity 28 of the motion 18 of the impact 24 between 12 and 26, thereby causing the potential energy of gravity 72 of mass 82 of device 10 to be converted to the active MVKE 34 of the fluid 12 and thence to the power 50.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A device for artificially converting molecular vibratory kinetic energy to energy of other form, independent of change of temperature of heat, said device comprising:

a) a phase-changeable working fluid having natural molecular vibratory motion and kinetic energy, b) a means for causing relative displacement motion which causes impact between said working fluid and a means for converting active molecular vibratory kinetic energy to the energy of another form, c) a means for controlling the rate of said relative displacement motion, d) an energy converting means with which said impact thereby causes the velocities of said molecular vibratory motion and a velocity of said relative displacement motion to combine and product a molecular microdynamic monodirectional force (M-force), a conversion of active molecular vibratory kinetic energy to energy of another form, a change of phase and consequent reduction in volume of molecules of said working fluid, a vacuum, and a residue of said working fluid, and e) a means for disposing said residue.

2. The device as specified in claim 1 wherein said phase-changeable fluid comprises a phase-changeable gas.

3. The device as specified in claim 1 wherein said phase-changeable fluid comprises a phase-changeable gas mixed with a gas which does not change phase.

4. The device as specified in claim 1 wherein said energy converting means is comprised of at least one transducer.

5. The device as specified in claim 4 wherein said at least one transducer is comprised of a vapor turbine.

6. The device as specified in claim 1 wherein said means for causing said relative displacement motion is comprised, at least in part, of a pump.

7. The device as specified in claim 1 wherein said means for causing said relative displacement motion is comprised, at least in part, of said vacuum.

8. The device as specified in claim 1 wherein said means for controlling the rate of said relative displacement motion is interposed between said phase-changeable fluid and said energy converting means.

9. The device as specified in claim 1 wherein said means for controlling the rate of said relative displacement motion is a valve.

10. The device as specified in claim 1 further comprising a means for preventing relative displacement motion of said device.

11. The device as specified in claim 1 wherein relative displacement motion of said device is permitted.

12. The device as specified in claim 1 wherein at least some of said energy of another form is power.

13. The device as specified in claim 12 further comprising a means for storing at least some of said power.

14. The device as specified in claim 12 wherein said power is used to power said relative motion means.

15. The device as specified in claim 12 wherein said power is used to power said means for disposing said residue.

16. The device as specified in claim 1 wherein at least some of said energy of another form is comprises of chemical energy.

17. The device as specified in claim 16 wherein said chemical energy is comprised, at least in part, of hydrogen dissociated from water.

18. The device as specified in claim 13 wherein said stored power is used to power said means for causing relative motion between said fluid and said energy converting means in the initial startup of said device.

19. The device as specified in claim 2 wherein said phase-changeable gas is manufactured by the evaporation of a phase-changeable liquid by the addition of energy of vaporization.

20. The device as specified in claim 19 wherein said phase-changeable liquid is comprised, at least in part, of said residue.

21. The device as specified in claim 19 wherein said energy of vaporization is comprised, at least in part, of said energy converted to another form.

22. The device as specified in claim 19 wherein said phase-changeable liquid acts as a refrigerant and energy of vaporization is comprised, at least in part, of heat obtained from substance desired to be reduced in temperature.

23. The device as specified in claim 19 wherein said phase-changeable liquid is impure and purified liquid is obtained from said residue.

24. The device as specified in claim 19 wherein said phase-changeable liquid is impure and concentrated impurity is obtained from said phase-changeable liquid.

25. The device as specified in claim 3 wherein said phase-changeable fluid is humidified air.

26. The device as specified in claim 3 wherein said phase-changeable fluid is artificially manufactured by causing evaporation of a phase-changeable liquid by a supplied energy of vaporization and the mixing of the resultant evaporated phase-changeable gas with said gas which does not change phase.

27. The device as specified in claim 26 wherein said phase-changeable liquid is comprises, at least in part, of said residue.

28. The device as specified in claim 26 wherein said phase-changeable liquid acts as a refrigerant and energy of vaporization is comprised, at least in part, of heat obtained from substance desired to be reduced in temperature.

29. The device as specified in claim 24 wherein at least some of said energy of vaporization is provided by said energy converted to another form.

30. The device as specified in claim 26 wherein at least some of said energy of vaporization is provided by heat energy naturally occurring within at least one component of said phase-changeable fluid.

31. The device as specified in claim 26 wherein said phase-changeable liquid is impure and purified liquid is obtained from said residue.

32. The device as specified in claim 26 wherein said phase-changeable liquid is impure and concentrated impurity is obtained from said phase-changeable liquid.

33. The device as specified in claim 1 further comprising means for converting added molecular vibratory potential kinetic energy derived from reduction of the temperature of said phase-changeable fluid.

34. The device as specified in claim 1 further comprising a means for hermetically sealing said device.

35. The device as specified in claim 10 wherein said means for preventing said relative displacement motion is comprised of anchorage of said device to earth.

36. The device as specified in claim 10 wherein said means for preventing said relative displacement motion of said device is comprises of a force which opposes the force tending to cause said motion.

37. The device as specified in claim 36 wherein said force tending to cause said motion is comprised of said M-force and said force which opposes said M-force is comprised of another M-force.

38. The device as specified in claim 36 wherein said force tending to cause said motion is comprised of said M-force and said force which opposes said M-force is comprised of the force of gravity.

39. The device as specified in claim 11 wherein said relative displacement motion of said device is caused, thereby causing relative displacement motion of the mass associated with said device.

40. The device as specified in claim 39 wherein a payload is included in said associated mass.

41. The device as specified in claim 39 wherein said relative displacement motion of mass is caused by said M-force acting in the direction away from said working fluid, whereby acceleration of velocity of said motion of mass is caused, thereby causing active MVKE of said working fluid to be converted to the kinetic energy of said motion of mass.

42. The device as specified in claim 41 wherein action of said M-force is discontinued, whereby said relative displacement motion of mass continues at a constant velocity, thereby preserving said kinetic energy of motion of said mass.

43. The device as specified in claim 42 wherein action of said M-force is discontinued by being balanced by an opposing M-force.

44. The device as specified in claim 42 further comprising means for causing said relative displacement motion of mass in the direction toward said M-force, whereby deceleration in velocity of said motion of mass is caused by action of said M-force, thereby causing relative motion of said energy converting device toward said working fluid and increase of the velocity of said impact between said fluid and said converting device and consequent conversion of kinetic energy of motion of said device to active MVKE of said working fluid and then to energy of another form.

45. The device as specified in claim 39 wherein said relative displacement motion of mass is caused by said M-force acting in the direction away from said working fluid, and also against the force of gravity, whereby increase of elevation of said mass within said force of gravity is caused, thereby causing said active MVKE of said working fluid to be converted to the potential energy of gravity of said mass.

46. The device as specified in claim 45 wherein said force of gravity is balanced by said M-force, whereby said relative displacement motion, increase of elevation, and conversion of said active MVKE to said potential force of gravity is discontinued, thereby preserving said potential energy of gravity of said mass.

47. The device as specified in claim 46 wherein said force of gravity overcomes said M-force, whereby relative displacement motion of said mass is caused in the direction toward said working fluid, thereby causing reduction of said elevation of mass within said force of gravity, relative displacement motion of said converting means toward said working fluid, increase of velocity of said impact, and conversion of gravitational energy of said mass to active MVKE of said working fluid and to energy of another form.

48. The device as specified in claim 11 further comprising a plurality of M-forces variously oriented which, when selectively activated upon a plurality of energy converting means, thereby can cause relative displacement motion of mass of said device in any direction.

49. The device as specified in claim 48 further comprising means whereby force of kinetic energy of motion of mass in any direction causes relative displacement motion of at least one of said plurality of energy conversion means toward at least one working fluid whereby increase of velocity of impact causes conversion of kinetic energy of mass to active MVKE of said working fluid and to energy of another form.

50. The device as specified in claim 39 further comprising a means whereby said relative displacement motion of said device is caused by energy converted by said energy converting means which is linked to means for causing traction effort of said device.

51. The device as specified in claim 11 further comprising means for stabilizing said device, such as gyroscopic means.

52. The device of claim 1 wherein said M-force is utilized for any purpose.

53. A molecular kinetic-energy conversion apparatus comprising:

a) means for containing a source of fluid wherein said fluid is comprised of phase changeable gas molecules, b) means for producing and controlling a flow velocity and volume applied to the omnidirectional, vibratory motion of said phase changeable gas molecules to produce a molecular monodirectional ballistic force, and c) means for converting said ballistic force into a power source which is applied to an external load.

54. A process for artificially converting molecular vibratory kinetic energy to energy of another form, independent of change of temperature of heat, said process comprising the steps of:

a) causing a relative displacement motion of a phase-changeable working fluid with respect to a means for converting active molecular vibratory kinetic energy to energy of another form, said working fluid comprising potential molecular vibratory kinetic energy, b) causing impact between said working fluid and said energy converting means, said impact thereby causing a molecular microdynamic monodirectional force (M-force) which acts only in the direction away from said working fluid, and c) converting active molecular vibratory kinetic energy by said converting means to energy of another form.

55. The process of claim 54 further comprising a step wherein said energy of another form is stored in an energy storage means.

56. The process of claim 54 wherein said energy of another form is comprised of electrical power.

57. The process of claim 54 wherein said energy of another form is comprised of chemical energy.

58. The process of claim 54 wherein said phase-changeable working fluid is comprised of a phase-changeable gas.

59. The process of claim 54 further comprising a step wherein said working fluid is manufactured by means of evaporation of a phase-changeable liquid with the addition of energy of evaporation.

60. The process of claim 54 wherein said phase-changeable liquid is impure and a step is added whereby purified liquid is obtained from condensate residue of vapor of said phase-changeable liquid.

61. The process of claim 59 wherein said phase-changeable liquid is impure and a step is added whereby concentrated impurity is obtained from the remnant reside of evaporation of said phase-changeable liquid.

62. The process of claim 59 wherein said energy of evaporation is comprised, at least in part, of said energy of another form.

63. The process of claim 58 further comprising a step wherein said working fluid is manufactured by means of evaporation of a phase-changeable liquid with the addition of energy of evaporation and further comprising a step wherein said evaporation is mixed with a gas which does not change phase.

64. The process of claim 63 further comprising a step wherein said energy of evaporation is provided, at least in part, by heat contained in at least one of the components of said working fluid.

65. The process of claim 63 further comprising a step wherein said energy of evaporation is provided, at least in part, by said energy converted to another form.

66. The process of claim 54 further comprising a step wherein said M-force also simultaneously causes relative displacement motion to mass, thereby converting active molecular vibratory kinetic energy of said working fluid to kinetic energy of said motion of mass.

67. The process of claim 54 further comprising a step wherein said M-force is overcome by the force of kinetic energy of mass, whereby relative displacement motion of said energy converting means toward said working fluid is caused, thereby converting kinetic energy of mass to active molecular vibratory kinetic energy of said working fluid.

68. The process of claim 54 further comprising a step wherein said M-force also simultaneously causes relative displacement motion to mass against the force of gravity, thereby causing elevation of said mass within the field of gravity and converting active molecular vibratory kinetic energy of said working fluid to potential gravitational energy of said mass.

69. The process of claim 54 further comprising a step wherein said M-force is overcome by the force of gravity upon said mass, whereby relative displacement motion of said energy converting means toward said working fluid is caused, thereby converting gravitational energy of said mass to active molecular vibratory kinetic energy of said working fluid.

70. The process of claim 53 wherein said M-force is used for any purpose.

* * * * *